US011319202B1

(12) United States Patent
Ziegmann

(10) Patent No.: US 11,319,202 B1
(45) Date of Patent: May 3, 2022

(54) BOTTLE FUNNEL WITH STABILIZER PROJECTIONS

(71) Applicant: N.P.Z., Inc., Lake View, IA (US)

(72) Inventor: Neil Ziegmann, Lake View, IA (US)

(73) Assignee: N.P.Z., Inc., Lake View, IA (US)

( * ) Notice: Subject to any disclaimer, the term of this patent is extended or adjusted under 35 U.S.C. 154(b) by 0 days.

(21) Appl. No.: 17/304,554

(22) Filed: Jun. 23, 2021

(51) Int. Cl.
*B67C 11/02* (2006.01)
*B67C 9/00* (2006.01)

(52) U.S. Cl.
CPC ..... *B67C 11/02* (2013.01); *B67C 9/00* (2013.01)

(58) Field of Classification Search
CPC ..... B67C 9/00; B67C 11/02
USPC ..... 141/319, 331–345
See application file for complete search history.

(56) References Cited

U.S. PATENT DOCUMENTS 509,005 A * 11/1893 Voeltzkow ..... A47B 3/12 248/431
1,548,410 A * 8/1925 Derbyshire ..... A47J 36/34 248/172
1,780,308 A * 11/1930 Morris ..... B05B 15/625 248/86
2,059,996 A * 11/1936 Goldberg ..... E01F 9/688 40/610
2,517,759 A 8/1950 Bentzen
2,703,670 A 3/1955 Voight
2,767,744 A 10/1956 Beerman
2,791,391 A * 5/1957 Uphoff ..... A47G 7/041 248/150
3,049,137 A * 8/1962 Cole ..... B08B 9/423 134/152
3,211,195 A 10/1965 Porter
3,309,055 A * 3/1967 Sefcik ..... A47B 3/12 248/431
4,004,850 A * 1/1977 Nelson ..... A01M 31/00 359/855
4,347,879 A * 9/1982 Blaser ..... B65D 71/502 141/364
5,029,795 A * 7/1991 Dexter ..... F16M 11/14 248/431
5,269,354 A 12/1993 Koberg
5,385,180 A * 1/1995 Wittman ..... B67C 11/02 141/106
5,472,025 A 12/1995 Conrad et al.
5,533,553 A 7/1996 Vesborg
5,642,763 A 7/1997 Kurtz
6,260,590 B1 * 7/2001 Ziegmann ..... B67C 9/00 141/332
6,684,922 B1 * 2/2004 Alston ..... B67C 9/00 141/364
7,302,976 B1 * 12/2007 Bultman ..... B67C 9/00 141/364

(Continued)

*Primary Examiner* — Timothy L Maust
(74) *Attorney, Agent, or Firm* — McKee, Voorhees & Sease, PLC

(57) ABSTRACT

A funnel has upper and lower ends adapted to be inserted into bottles or containers to stack a first container above a second container to allow liquid to drain from the inverted first container into the upright second container. The upper end of the funnel includes resilient posts, with a spacer extending therebetween to provide a stable fit of the upper end into the first container. The tops of the posts include enlarged caps to preclude the spacer from sliding off the posts and possibly becoming lost.

20 Claims, 4 Drawing Sheets

(56) References Cited

U.S. PATENT DOCUMENTS

| | | | | |
|---|---|---|---|---|
| 8,857,481 | B2 * | 10/2014 | Aviles | E03F 5/041 141/340 |
| 9,220,339 | B1 * | 12/2015 | Chen | A63B 47/00 |
| 11,007,815 | B1 * | 5/2021 | Wrubel | B01F 15/00746 |

* cited by examiner

BOTTLE FUNNEL WITH STABILIZER PROJECTIONS

FIELD OF THE INVENTION

The field of invention is liquid transfer devices, and particularly a device for transferring a high viscous liquid from a nearly empty bottle or container to another bottle or container.

BACKGROUND OF THE INVENTION

High viscosity liquids are often packaged in bottles or other containers and can be dispensed by pouring or pumping. It is difficult to completely empty the contents of such liquids from the bottle, leading to discarding of the bottles with residual liquid therein. Thus, product is wasted and costs to the user of consumer are increased. Examples of these liquids include hand lotion, shampoo, food condiments such as ketchup, barbeque sauce, salad dressing and syrup, motor vehicle oil, glue and others.

U.S. Pat. No. 6,260,590 is directed toward a funnel for transferring such liquids from the nearly-empty bottle or container to a second bottle or container. The funnel includes a lower end which fits into the upright second bottle and posts extending upwardly into the neck of the first bottle which is inverted on top of the funnel to allow liquid to drain through the funnel into the second bottle. The commercial embodiment of the U.S. Pat. No. 6,260,590, sold under the name "The Fun-All," is made of plastic, such that the posts are somewhat flexible or resilient. In use, the posts are inserted into the neck of the bottle to be drained, and the spacer is slid up or down to hold the funnel in position. Then, the bottom funnel is turned upside down and the bottom of the funnel is inserted into the neck of the bottle to receive the liquid. The funnel aligns the necks of the two bottles and holds the first bottle over the second bottle until the liquid contents are emptied from the first bottle into the second bottle. An X-shaped spreader or spacer is snap fit onto the posts and slides upwardly and downwardly so that the posts provide a stable support inside the neck of the inverted first bottle. However, the spreader or spacer can slide off the top of the posts and become lost, for example during cleaning of the funnel.

Accordingly, a primary objective of the present invention is the provision of an improved funnel for liquid transfer between bottles or containers which eliminates accidental sliding of the spreader or spacer off of the funnel posts.

Another objective of the present invention is the provision of caps or stoppers on the ends of the funnel posts to prevent the spreader or spacer from sliding off the posts.

A further objective of the present invention is the provision of an enlarged head on the posts of the funnel which retains the spreader on the posts.

Still another objective of the present invention is the provision of a funnel with molded caps on the ends of the posts to preclude inadvertent disassembly of the spreader from the posts.

These and other objectives will become apparent from the following description of the invention.

SUMMARY OF THE INVENTION

The liquid transfer funnel of the present invention includes opposite ends for insertion into the necks of bottles to allow a first bottle to be positioned above a second bottle so that the contents of the first bottle can drain into the second bottle. The upper and lower ends of the funnel are tapered to accommodate different sized neck openings of the first and second bottles. The upper end of funnel includes resilient posts with a slidable spreader or spacer which is slid upwardly along the posts after the posts are inserted into the neck of the first bottle to hold the funnel in position. The upper ends of the posts include enlarged caps which prevent the spacer or spreader from sliding off the posts, thereby minimizing the risk that the spacer will be lost.

DETAILED DESCRIPTION OF THE INVENTION

Figure 1:
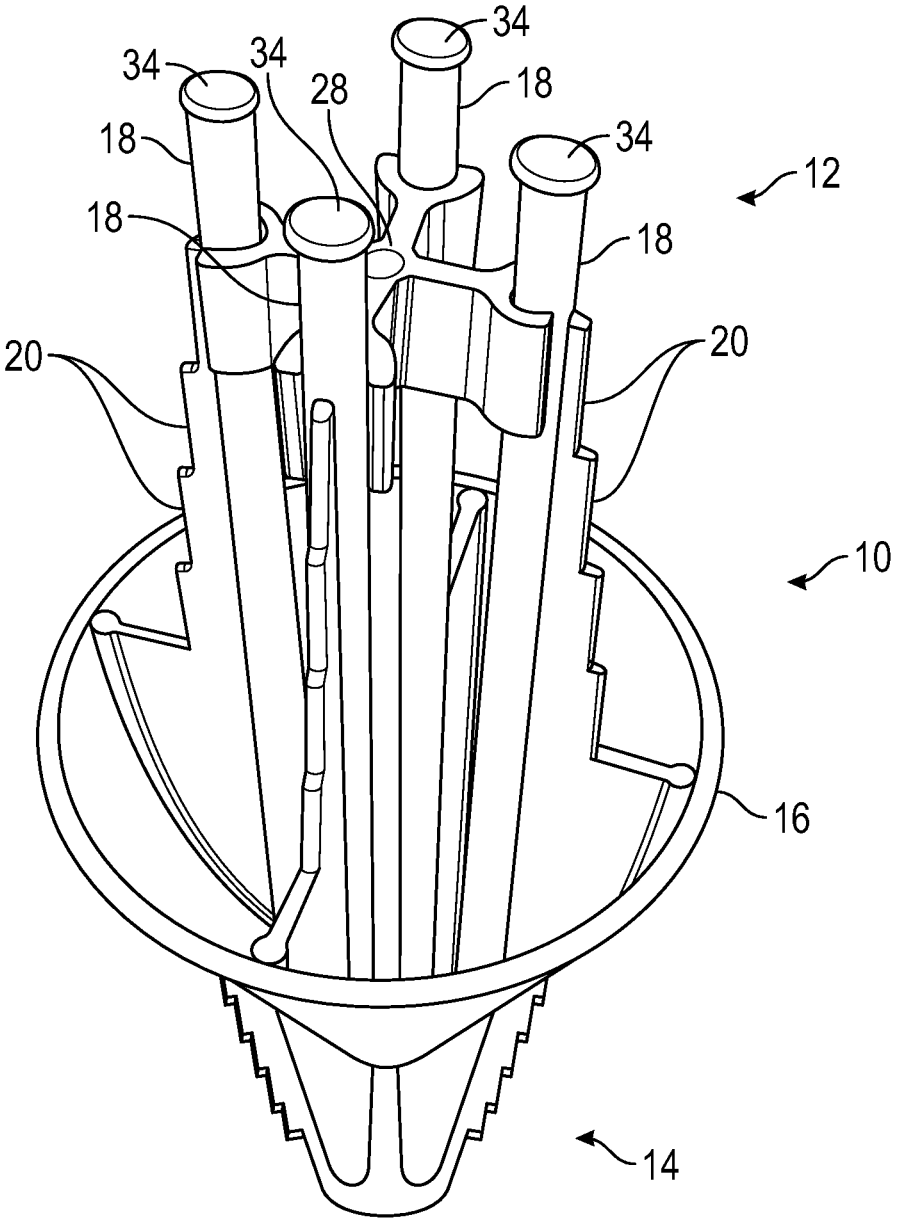
FIG. 1 is a perspective view of the funnel of the present invention.
Figure 2:
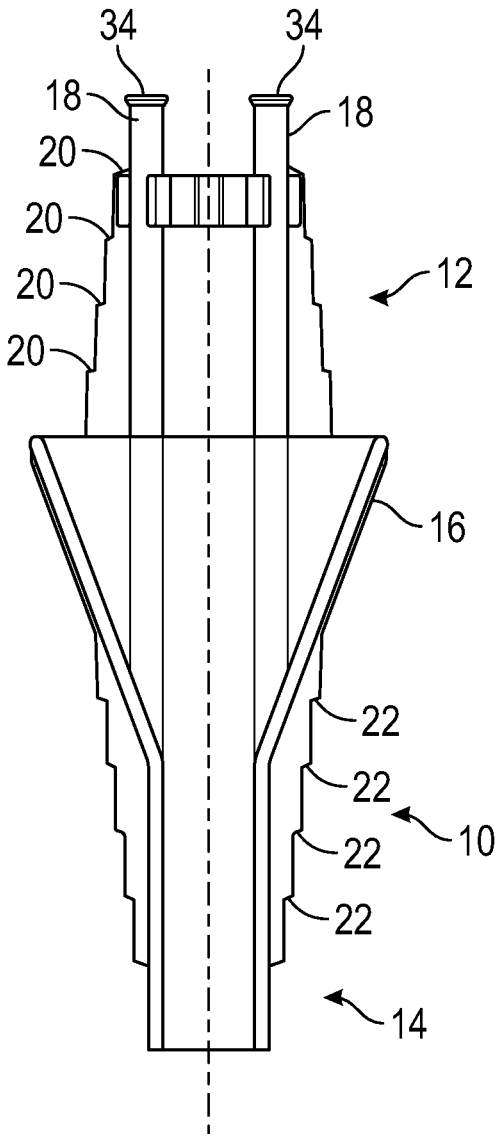
FIG. 2 is a side elevation view of the funnel.
Figure 3:
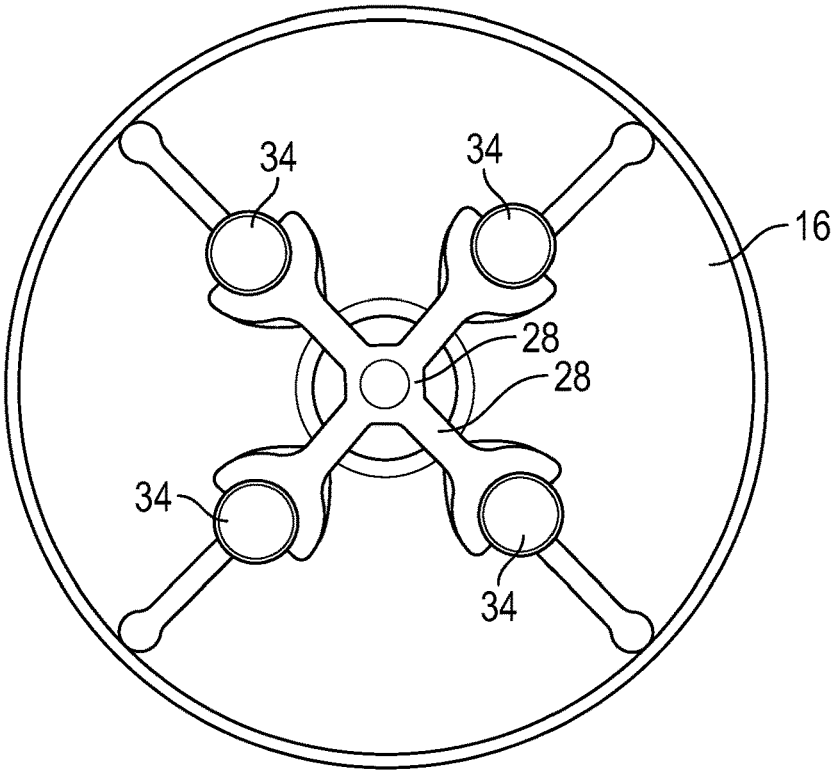
FIG. 3 is a top view of the funnel and the spreader.
Figure 4:
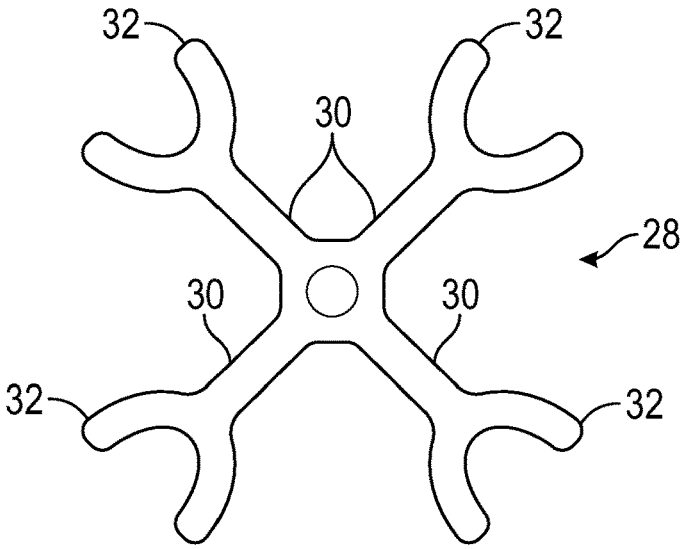
FIG. 4 is a top view of the spreader.
Figure 5:
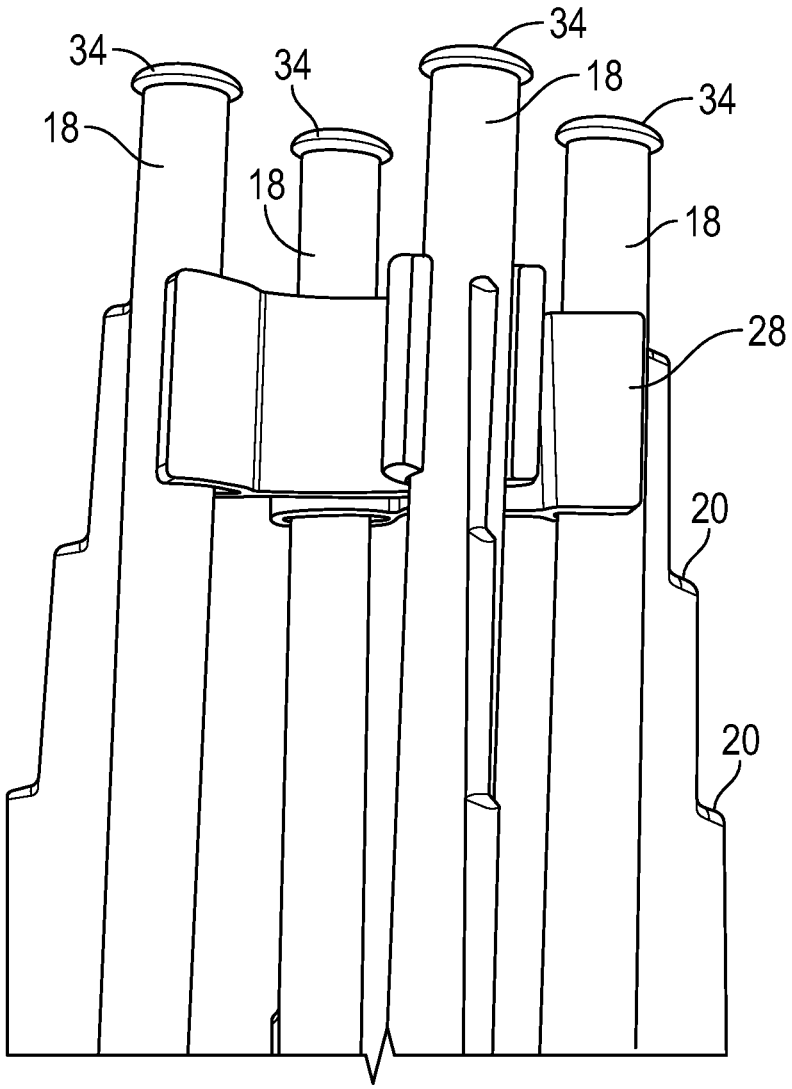
FIG. 5 is an enlarged view showing the post caps for retaining the spreader on the posts.

A bottle funnel 10 includes a body with an upper end 12 and a lower end 14, and an enlarged diameter mid-portion 16. Preferably, the funnel 10 has a molded, one-piece construction. The upper end 12 includes a plurality of posts 18. While the drawings show a preferred use of four posts 18, it is understood that three posts could be utilized. Each of the posts 18 include a series of steps 20, to increase the effective circumference around the posts from top to bottom. Similarly, the lower end 14 of the funnel 10 includes a series of steps 22, to effectively increase the circumference of the lower end from the bottom towards the top. The steps 20, 22 allow the funnel 10 to accommodate different sized neck openings of the containers 24, 26. The posts 18 are adapted to be inserted into the open neck of a first bottle or container 24, while the lower end 14 is adapted be inserted into the open neck of a lower bottle or container 26. In use, the posts 18 are inserted into the neck of the first bottle 24, while bottle 24 is upright, and then the bottle 24 is inverted so that the lower end 14 of the funnel 10 can be inserted into the upright lower bottle 26. The funnel 10 is hollow to allow liquid to drain from the upper bottle 24 to the lower bottle 26.

A spreader or spacer 28 is slidably mounted on the posts 18. The spreader 28 has arms 30 each having an end 32 adapted to snap fit onto the posts 18, such that the spacer 28 can slide upwardly and downwardly along the posts 18 to firmly position the upper end 12 of the funnel 10 in the neck of the first bottle 24.

The above description of the funnel 10 and the spacer 28 is conventional.

The invention is directed toward an enlarged cap 34 on the top of each post 18. Preferably, the caps 34 are molded with the posts 18 so as to have an integral, one-piece construction. Thus, the caps 34 are not intended to be removed from the posts 18. The caps 34 prevent the spacer/spreader 28 from accidentally sliding off of the ends of the posts. The caps 34 do not preclude the ends 32 of the arms 30 of the spacer 28 from being unsnapped from the posts, such as for cleaning purposes. The caps 34 retain the spacer 28 on the posts 18, except when manual removal of the spacer is intended. The caps 34 do not interfere with the flow of liquid from the first container 24 into the second container 26 during use of the funnel 10.

The embodiments, variations, and figures described above are provided as an indication of the utility and versatility of the present invention. Other embodiments that do not provide or otherwise utilize all of the features, processes and advantages set forth herein may also be utilized, without departing from the spirit and scope of the present invention. Such modifications and variations are considered to be within the scope of the principles of the invention as defined by the claims set forth below.

What is claimed is:

1. A funnel for transferring flowable material from a first container into a second container, each container having an open top, the funnel comprising:

a hollow body having an upper end adapted for insertion into the open top of the first container and a lower end adapted for insertion into the open top of the second container;

the upper end of the hollow body having a plurality of posts adapted to extend into the first container;

a spreader slidably mounted on and extending between the posts to stabilize the posts when positioned in the first container; and a stopper on an upper end of one of the posts to limit upward sliding movement of the spreader on the posts and thereby prevent the spreader from sliding off the upper end of the posts;

wherein the material will flow from the first container through the hollow body and into the second container.

2. The funnel of claim 1 further comprising stoppers on upper ends of all the posts.

3. The funnel of claim 1 wherein the one post has an upper diameter and the stopper has a diameter greater than the diameter of the one post.

4. The funnel of claim 1 wherein the stoppers form a lip at the upper end of the one post.

5. The funnel of claim 1 wherein the spreader snaps onto the one post and an opposite post.

6. The funnel of claim 1 wherein the spreader has diverging arms with outer ends that slidably mount on the posts.

7. The funnel of claim 1 wherein the spreader is X-shaped.

8. The funnel of claim 1 wherein the stopper and the one post are integrally formed.

9. The funnel of claim 1 wherein the hollow body has steps at the upper and lower ends.

10. The funnel of claim 1 wherein the upper and lower ends of the funnel are adapted to slide into the open tops of the first and second containers without connection to the containers.

11. A funnel for use with first and second bottles, comprising:

a hollow body with a plurality of posts extending upwardly for insertion into an open neck on the first bottle and having a lower end for insertion into an open neck on the second bottle so that material in the first bottle can flow through the hollow body into the second bottle;

a spreader having outwardly extending arms with outer ends mounted on the posts and being slidable along the posts; and each post having an enlarged cap to retentively engage the outer ends of the arms to keep the spreader from sliding off the posts.

12. The funnel of claim 11 wherein the posts and spreader are molded plastic.

13. The funnel of claim 11 wherein arms form an X shape between the posts.

14. The funnel of claim 11 wherein the posts are spaced equidistance from one another.

15. The funnel of claim 11 wherein the spreader snaps onto the posts below the caps.

16. The funnel of claim 11 further comprising steps on the lower end of the body.

17. The funnel of claim 11 further comprising steps on the posts.

18. The funnel of claim 11 wherein posts have a constant diameter and the enlarged caps each have a diameter greater than the diameter of the posts.

19. The funnel of claim 11 wherein the hollow body, posts and enlarged caps have a 1-piece construction.

20. The funnel of claim 11 wherein the hollow body is mounted in the containers without attachment thereto.

* * * * *